US009745733B2

(12) United States Patent
Ahlmann et al.

(10) Patent No.: US 9,745,733 B2
(45) Date of Patent: Aug. 29, 2017

(54) DRAINAGE CHANNEL WITH A DRAINAGE BODY AND A COVER

(71) Applicant: ACO SEVERIN AHLMANN GMBH & CO KOMMANDITGESELLSCHAFT, Büdelsdorf (DE)

(72) Inventors: Hans-Julius Ahlmann, Büdelsdorf (DE); Jan Mieze, Kiel (DE); James Canney, Bedfordshire (GB); Stephan Meier, Albersdorf (DE)

(73) Assignee: ACO SEVERIN AHLMANN GMBH & CO. KG, Budelsdorf (DE)

( * ) Notice: Subject to any disclaimer, the term of this patent is extended or adjusted under 35 U.S.C. 154(b) by 0 days.

(21) Appl. No.: 14/426,887

(22) PCT Filed: Sep. 9, 2013

(86) PCT No.: PCT/EP2013/068581
§ 371 (c)(1),
(2) Date: Mar. 9, 2015

(87) PCT Pub. No.: WO2014/037555
PCT Pub. Date: Mar. 13, 2014

(65) Prior Publication Data

US 2015/0240470 A1 Aug. 27, 2015

(30) Foreign Application Priority Data

Sep. 10, 2012 (DE) ..... 10 2012 108 387

(51) Int. Cl.
*E03F 3/04* (2006.01)
*E03F 5/06* (2006.01)
(Continued)

(52) U.S. Cl.
CPC ..... *E03F 5/0401* (2013.01); *E01F 5/005* (2013.01); *E03F 3/046* (2013.01); *E03F 5/04* (2013.01);
(Continued)

(58) Field of Classification Search
CPC ..... E01F 5/005; E03F 5/0401; E03F 5/041; E03F 5/04; E03F 5/046; E03F 5/06; E03F 2005/065; E03F 2005/068; E03F 3/046
See application file for complete search history.

(56) References Cited

U.S. PATENT DOCUMENTS 780,981 A * 1/1905 Daggett ..... E01F 5/005 285/399
2,305,955 A * 12/1942 Dudley ..... E03F 5/06 210/163
(Continued)

FOREIGN PATENT DOCUMENTS

DE 29617125 U1 1/1997
EP 248427 A2 12/1987
(Continued)

OTHER PUBLICATIONS

International Search Report and Written Opinion issued in International Patent Application No. PCT/EP2013/068581; Mailing Date of ISR Nov. 15, 2013; English translation of ISR included.
(Continued)

*Primary Examiner* — Abigail A Risic
(74) *Attorney, Agent, or Firm* — Pearne & Gordon LLP

(57) ABSTRACT

A stable and variable design of a drainage structure includes a drainage body (11) and a cover (20). The cover (20) has engagement devices (13, 13'; 14, 14'; 23, 23') when seen in a longitudinal direction of the drainage body (11), whereby the cover connects upper edges (12, 12') of the drainage body (11) to one another transversely to the longitudinal
(Continued)

Figure 1:
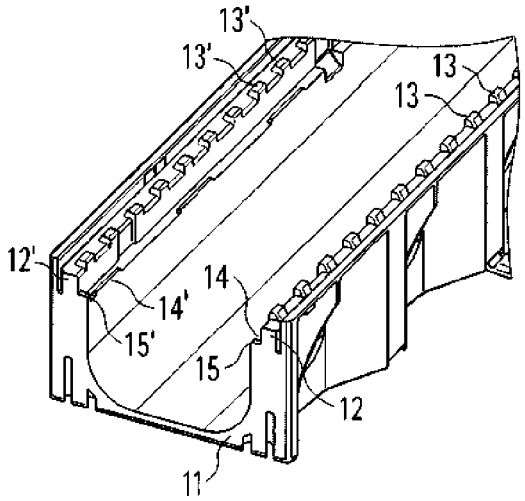

direction in a tension-resistant manner over the entire length of the drainage body. In order to allow the use of different covers (20) for different loads, for example while using the same drainage body (11), two types of engagement devices (13, 13'; 14, 14') are provided on the drainage body.

9 Claims, 1 Drawing Sheet

(51) Int. Cl.
*E03F 5/04* (2006.01)
*E01F 5/00* (2006.01)
*E03F 5/046* (2006.01)

(52) U.S. Cl.
CPC ..... *E03F 5/041* (2013.01); *E03F 5/046* (2013.01); *E03F 5/06* (2013.01); *E03F 2005/065* (2013.01); *E03F 2005/068* (2013.01)

(56) References Cited

U.S. PATENT DOCUMENTS 5,181,793 A 1/1993 Dekel
7,637,695 B1 * 12/2009 Akkala ..... E03F 5/06 404/2
2004/0126187 A1 * 7/2004 Rathmann ..... E03F 5/06 405/40
2006/0159515 A1 * 7/2006 Messerschimidt ..... E03F 5/06 404/4
2007/0144954 A1 * 6/2007 Neuber ..... E03F 5/06 210/163
2007/0293008 A1 * 12/2007 Hodgekins ..... E01C 11/227 438/270
2013/0161246 A1 * 6/2013 Meincke ..... E03F 5/06 210/163
2014/0332453 A1 * 11/2014 Torras-Pique ..... E01C 11/227 210/163

FOREIGN PATENT DOCUMENTS

EP 2468969 A2 6/2012
JP 2002302995 A 10/2002
JP 2002348945 A 12/2002
JP 2004293204 A 10/2004
JP 3128682 12/2006
JP 2013-057211 A 3/2013
RU 2327841 C2 6/2008
WO 2011150447 A1 12/2011

OTHER PUBLICATIONS

Office Action issued in corresponding Japanese Application No. 2015-530436; Dated: Sep. 16, 2016.
The Search Report issued by the Russian Federation Patent Office in Corresponding Patent Application 2015113017/13; Mailing Date: Feb. 23, 2017.

* cited by examiner

DRAINAGE CHANNEL WITH A DRAINAGE BODY AND A COVER

The invention relates to a drainage channel having a drainage body and a cover according to the preamble of Claim 1.

Drainage channels having a cover are widely known. A major problem with such items is that, on the one hand, there must be a design that is favorable in terms of the cost of production, but on the other hand, the installation and assembly must be simple. In addition, the load capacity of the drainage channel with its cover is an essential criterion, since these will be installed and driven over in streets and public open spaces.

When the drainage channel and the cover are manufactured out of an appropriately stable material and the two parts are screwed together, a high-strength structure is created that is able to withstand higher loads; however the manufacturing costs and also the amount of work upon installation in the ground are substantial. In addition, the manufacturing and storage costs are high.

The object of the invention is to provide a drainage channel having a drainage body of the type mentioned above, such that even with a simple design and low manufacturing and storage costs, said drainage channels nevertheless have a high degree of strength when installed in the ground.

This object is achieved by a drainage channel according to Claim 1.

This object is achieved in particular by a drainage channel having a drainage body and a cover such that, when viewed in a longitudinal direction of the drainage body, the drainage body and the cover have continuous first engagement devices on the drainage body and continuous engagement devices on the cover, which cover connects upper edges of the drainage body to one another, transverse to the longitudinal direction, in a high tensile manner over the entire length of the drainage body. This creates a closed box design that, on the one hand, is easy to manufacture and install, but on the other hand, also has a high resistance to loads.

The first engagement devices are disposed in this case in different array patterns on the drainage body in such a way that different kinds of covers can be used with a (single) drainage body. In this way, different kinds of covers in terms of stability and design can be used, for which different kinds of drainage bodies were needed previously, which reduces manufacturing and storage costs.

The first engagement devices comprise teeth on the drainage body, the second engagement devices comprise guide rails on the cover (or vice versa), which engage with one another. Because the engagement devices are provided along the entire length of the drainage channel, the stability of the individual teeth (and guide rails) can be relatively low. The necessary stability is ensured simply through the quantity of engagement devices (or, respectively, of teeth).

The first engagement devices are preferably disposed in different height levels of the drainage body. This is applicable in particular when, as mentioned above, different kinds of covers are to be used with the same drainage body. In addition, it is also possible to design the covers in such a way that they are connected to, or, respectively, are supported on the drainage body at multiple points, thus in the different height levels. This can further increase the load capacity of the drainage channel.

In a first embodiment of the invention, the second engagement devices are mounted on the cover on a lower surface of peripheral groove supports. This results in a very simple design.

The second engagement devices may alternatively (or additionally) be designed as lower edges of peripheral longitudinal supports of the cover so that a design element of the cover is used that is already present (for reasons of stability).

In addition, stopper devices are preferably provided, which limit a displacement of the cover relative to the drainage body in the longitudinal direction thereof, so that the cover rests essentially immovably on the drainage body even in the case of loads on the cover in a longitudinal direction of the drainage channel (e.g. when a vehicle brakes or accelerates while rolling over the top thereof).

In addition, it is advantageous when the first engagement devices are designed with the second engagement devices so that they work together in such a way that they limit a displacement of the cover [relative] to the drainage body in the longitudinal direction thereof, as the above mentioned stopper devices alternatively or additionally do.

The entire design can then be manufactured to be especially light and (due to its low weight) can also be easily installed, when the drainage body is designed as a plastic injection molded part. The same applies to the cover, which likewise may be designed as a plastic injection molded part.

Figure 2:
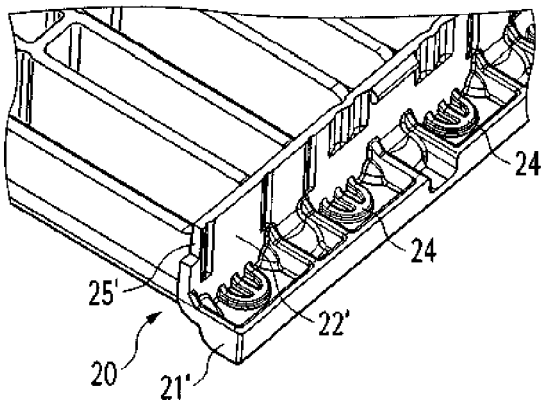
Figure 3:
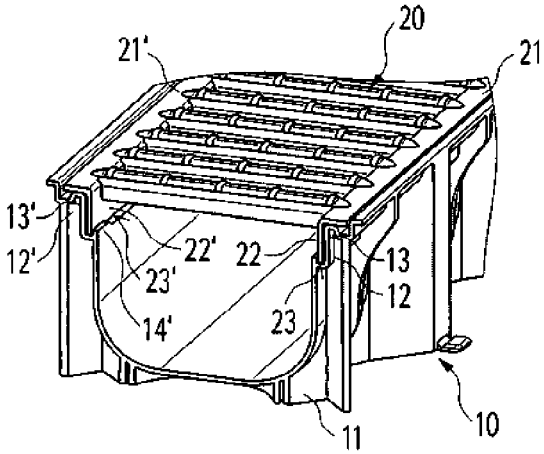
Figure 4:
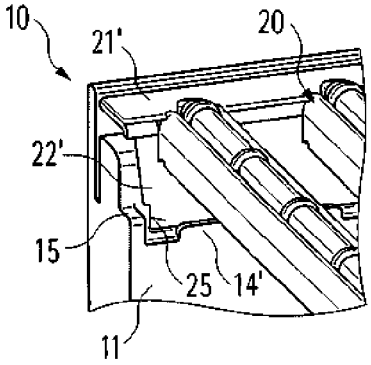

Preferred embodiments of the invention will be described in detail below on the basis of the Figures. Shown are:

FIG. 1 a perspective partial view of a drainage body,

FIG. 2 a perspective partial view (from below) of a cover,

FIG. 3 a perspective partial view of the drainage body according to FIG. 1 having a cover that has been modified vis-a-vis the embodiment according to FIG. 2 and FIG. 4 a perspective partial view from another view angle of the object according to FIG. 3.

In the following description, the same reference characters are used for identical or identically functioning parts.

The drainage channel shown in FIGS. 1 and 2 comprises a drainage body 11 and a cover 20. Both parts are designed as plastic injection molded parts.

Upper teeth 13, 13' are provided on upper edges 12, 12' of the drainage body 11, which upper teeth form a continuous row of teeth over the entire length of the drainage body. These teeth 13, 13' engage with guide rails 24, which are provided on the lower surface of a groove support 21, 21' of the cover 20 and which stabilize this groove support. The groove supports 21, 21' project outwardly from longitudinal supports 22, 22'. When the cover 20, which is shown in FIG. 2, is fitted on the drainage body 11, the guide rails 24 engage with the upper teeth 13, 13', so that a high tensile connection between the upper edges 12, 12' of the drainage body (and at the same time, a shear-resistant connection) is formed. Then when in an assembled state, the drainage channel has a completely closed box profile, which has a high degree of stability.

The engagement of the guide rails 24, which are shown in FIG. 2, with the upper teeth 13, 13' of the drainage body 11 not only creates the above described high tensile connection, rather, the cover 20 is secured on the drainage body 11, likewise when viewed in the longitudinal direction of the drainage channel 10. This securing also occurs over the entire length of the drainage channel 10, so that a very high degree of stability is ensured.

In addition, FIG. 1 also shows that a second row of teeth, namely the lower teeth 14, 14', is provided on the drainage body 11. These lower teeth 14, 14' come into contact with lower edges 23, 23' of longitudinal supports 22, 22' of a cover 20 having a different form, as is shown in FIGS. 3 and 4. The cover 20 shown thereon is formed out of sheet steel. Groove supports 21, 21' of the cover 20 according to FIGS. 3 and 4 rest on the upper teeth 13, 13', wherein here again, the continuous mounting of rows of teeth 13, 13' ensures adequate stability in the case of vertical load. In addition, the cover 20 is resting such that it is supported twice; once with the groove supports 21, 21' thereof on the upper teeth 13, 13' and once with the longitudinal supports 22, 22' thereof in the region of the lower teeth 14, 14', so that increased stability with respect to vertical loads is ensured. In order to prevent a displacement of the cover according to FIGS. 3/4 in the longitudinal direction of the drainage channel 10, stopper projections 15 are provided at the ends of the drainage body 11, 15', which projections engage with end edges 25, 25' of the cover 20 (see in particular FIG. 4), when the cover 20 is displaced in the longitudinal direction of the drainage channel 10, for example by a braking or accelerating vehicle.

From the above, it is clear that the above mentioned high tensile connection between the upper edges 12, 12' is also ensured when a cover 20 having a different shape (as shown in FIGS. 3 and 4) is used together with the drainage body 11.

REFERENCE CHARACTERS

10 drainage channel
11 drainage body
12, 12' upper edge
13, 13' upper teeth
14, 14' lower teeth
15, 15' stopper projection
20 cover
21, 21' groove support
22, 22' longitudinal supports
23, 23' lower edge
24 guide rails
25, 25' end edge

The invention claimed is:

1. A drainage channel having a drainage body (11) and a cover (20), wherein, when viewed in a longitudinal direction of the drainage body (11), the drainage body (11) and the cover (20) have continuous first engagement devices (12, 12'; 13, 13') comprising a continuous row of upper teeth on the upper edge of the drainage body and a row of lower teeth (14, 14') on the drainage body (11), the row of lower teeth disposed at a different height than the continuous row of upper teeth, and second engagement devices (23, 24) comprising longitudinal supports (22, 22') on the cover (20), wherein the upper teeth engage with the second engagement devices such that the cover is secured to the drainage body and the cover connects upper edges (12, 12') of the drainage body (11) to one another, transverse to the longitudinal direction, in a high tensile manner over the entire length of the drainage body, and wherein the row of lower teeth (14, 14') engage a lower edge of the longitudinal supports (22, 22') of the cover (20) to support the cover on the drainage body.

2. The drainage channel according to claim 1, characterized in that the second engagement devices comprise guide rails (23, 24) on the cover (20).

3. The drainage channel according to claim 1, characterized in that the upper teeth are disposed vertically above the lower teeth of the first engagement devices (12, 12', 13, 13', 14, 14') of the drainage body (11).

4. The drainage channel according to claim 1, characterized in that the second engagement devices (24) are mounted on the cover (20) on a lower surface of peripheral groove supports (21).

5. The drainage channel according to claim 4, characterized in that the second engagement devices are formed as lower surfaces (23, 23') of the peripheral longitudinal supports (22, 22') of the cover (20).

6. The drainage channel according to claim 5, characterized in that stopper devices (15, 15'; 25, 25') are provided, which limit a displacement range of the cover (20) relative to the drainage body (11) in the longitudinal direction thereof.

7. The drainage channel according to claim 1, characterized in that stopper devices (15, 15'; 25, 25') are provided, which limit a displacement range of the cover (20) relative to the drainage body (11) in the longitudinal direction thereof.

8. The drainage channel according to claim 1, characterized in that the continuous row of upper teeth (13, 13') are designed to interact with the second engagement devices (24) such that they limit a displacement range of the cover (20) relative to the drainage body (11) in the longitudinal direction thereof.

9. The drainage channel according to claim 1, characterized in that the drainage body (11) and/or the cover (20) are designed as plastic injection molded parts.

* * * * *